United States Patent [19]

James

[11] Patent Number: 4,962,924

[45] Date of Patent: Oct. 16, 1990

[54] BATTING TEE

[76] Inventor: William J. James, R.R. 5, Box 15, Sullivan, Ind. 47882

[21] Appl. No.: 440,801

[22] Filed: Nov. 24, 1989

[51] Int. Cl.[5] ..... A63B 69/00

[52] U.S. Cl. ..... 273/26 R

[58] Field of Search ..... 273/25, 26 R, 33, 29 A, 273/202–212, 183 A, 195 R, 195 B, 196, 186 R

[56] References Cited

U.S. PATENT DOCUMENTS

| | | | |
|---|---|---|---|
| 2,964,316 | 12/1960 | Rose | 273/26 R |
| 3,112,111 | 11/1963 | Bennett | 273/203 |
| 3,940,131 | 2/1976 | Claire, Jr. | 273/26 R |
| 4,445,685 | 5/1984 | Cardieri . | |
| 4,456,250 | 6/1984 | Perrone, Jr. . | |
| 4,463,950 | 8/1984 | Elkin | 273/26 R |
| 4,664,374 | 5/1987 | Groves | 273/26 R |
| 4,709,924 | 12/1987 | Wilson et al. . | |
| 4,786,057 | 11/1988 | Brown | 273/183 A |
| 4,796,885 | 1/1989 | Wright | 273/26 R |
| 4,819,937 | 4/1989 | Gordon | 273/26 R |

*Primary Examiner*—Theatrice Brown

*Attorney, Agent, or Firm*—Barnes & Thornburg

[57] ABSTRACT

A batting tee includes a base plate having an upper surface and a lower surface including a slot extending in a plurality of discrete directions over said surfaces. A perimeter joining the upper and lower surfaces encompasses an area having a configuration of the sum of a conventional home plate and a forward extension thereto having outwardly flaring side edges. A fastener is situated in and is adjustably movable with respect to the slot. An upright ball support has a lower end coupled to the fastener and an upper end adapted to support a ball. The slot is in the form of inverted T-shaped groove in the upper surface of the base plate and include mutually confronting edges. A portion of the upper surface contiguous to the confronting edges are distinguished from the remainder of the upper surface of the base plate by a difference in surface color outlining the slot.

20 Claims, 2 Drawing Sheets

BATTING TEE

BACKGROUND OF THE INVENTION

This invention relates generally to the sports of baseball and softball, and more particularly to devices suitable for assisting in the teaching of a proper batting swing.

Batting tees are well known in the art and are used for teaching players of baseball and softball how to improve their swing with a bat. Batting tees typically have a support member intended to be positioned upon the ground. Often the support member has had the appearance of a home plate so as to aid in assisting the proper positioning of the batter. A vertical member in the nature of a pipe or post typically extends upward from the supporting base and terminates in a flexible piece of material such as rubber upon which a baseball or softball may be positioned. The height of the upper end of the vertical support is typically adjustable to simulate high and low pitches as well as to adapt the batting tee for use by players of different size.

It has been recognized that certain advantages are enjoyed by permitting the vertical ball support to move with respect to the base support to different locations so as to simulate inside and outside pitches. It has additionally been recognized that it is desirable in some circumstances that the ball be hit in front of the plate rather than over the plate and hence means have been provided for positioning the vertical ball support at various locations in front of the home plate portion of the supporting base.

In the teaching of a proper batting swing, it is often difficult to persuade batters of the desirability of timing their swing so that contact between the bat and ball is achieved at a different forward or rearward position with respect to the home plate depending upon whether the pitch is inside or outside. It is therefore an object of the present invention to provide the batting tee which will assist in the teaching of a proper batting swing which will reinforce the desirability of coordinating the contact position between the bat and ball depending upon whether the pitch is inside or outside. It is further an object of the present invention to provide a batting tee which reinforces the teaching for both right and left-handed batters based on a common coordination scheme.

SUMMARY OF THE INVENTION

A batting tee in accordance with the present invention generally comprises a base having an upper and a lower surface, the upper surface integrally including a plurality of slots. A fastener is situated in at least one of the plurality of slots and is adjustably movable with respect to the slot along the longitudinally extent thereof. An upright ball support has a lower end coupled to the fastening means and an upper end adapter to support the ball, the upright ball support being positionable at any location along the longitudinally extent of the plurality of slots.

In the preferred embodiment, a perimeter joins the upper and lower surfaces of the base and encompasses an area having a configuration of the sum of a conventional home plate and a forward extension thereto having outwardly flaring side edges. The plurality of slots are preferably configured as a pair of diagonal slots intersecting at about the center of the forward extension of the home plate. Each of the diagonal slots includes rearwardly extending portions at each end. An additional slot extends rearwardly from the point of intersection of the two diagonal slots.

The forward extension preferably includes a surface color different from the home plate portion of the base. Further, the edges of the plurality of slots are distinguished from the remainder of the upper surface by a difference in color. The confronting edges of one diagonal slot are decorated with a color different from the confronting edges of the other diagonal slot so as to permit easy reference by both right and left batters.

Additional features of the invention will become apparent to those skilled in the art upon consideration of the following detailed description of the preferred embodiment exemplifying the best mode of carrying out the invention as presently perceived. The detailed description particularly refers to the accompanying drawings.

DESCRIPTION OF PREFERRED EMBODIMENT

Figure 1:
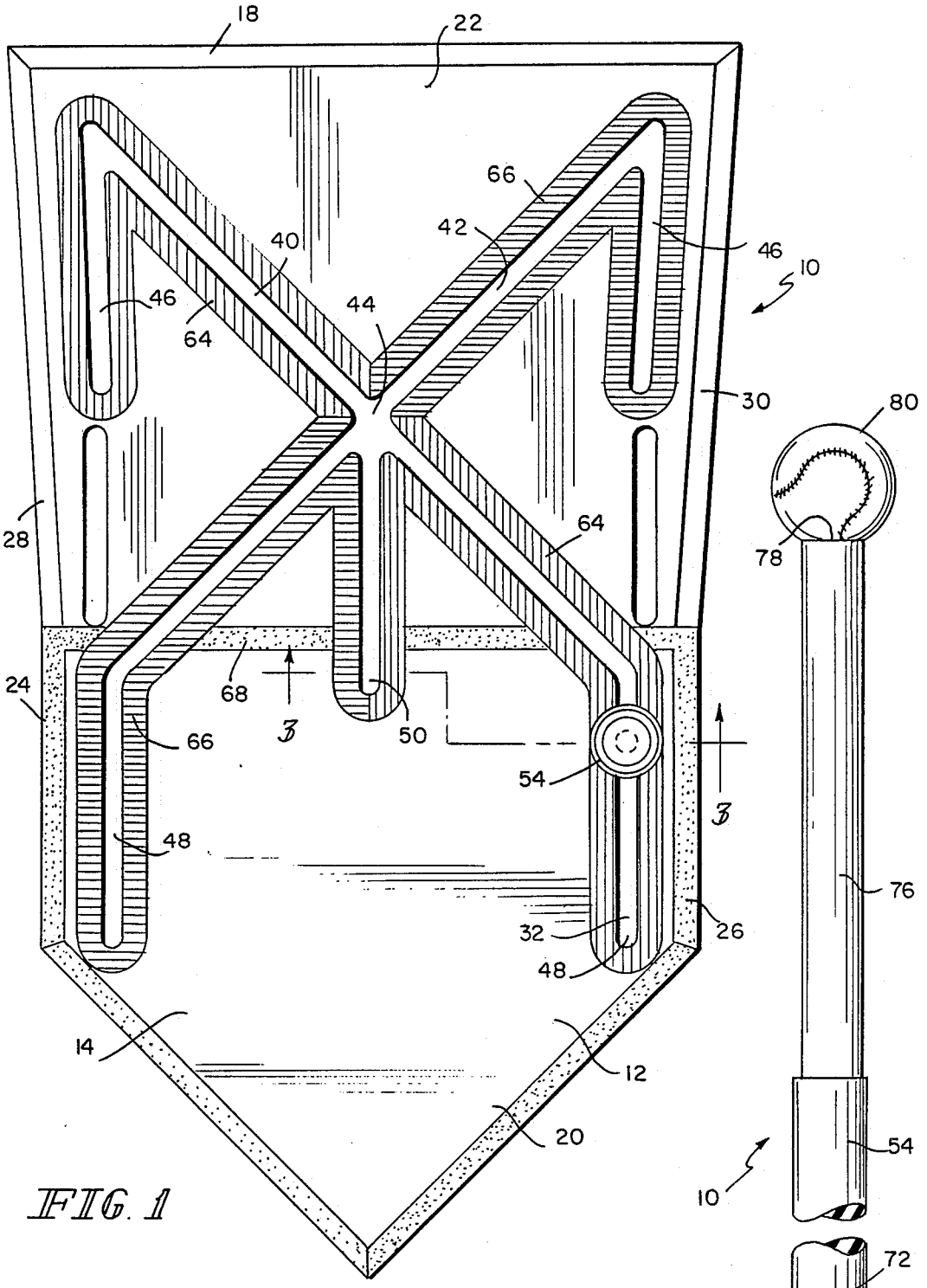
FIG. 1 is a top plan view of a batting tee in accordance with the present invention.

A batting tee 10 in accordance with the present invention is illustrated in the accompanying FIGS. 1–4 to include a base 12 having an upper surface 14 and a lower surface 16. A perimeter 18 joins the upper surface 14 to the lower surface 16 and encompasses an area having a configuration of the sum of a conventional home plate 20 and a forward extension 22. While the home plate portion 20 has parallel sides 24 and 26, the forward extension has outwardly flaring side edges 28 and 30. The perimeter 18 including edges 24, 26, 28, and 30 which are shown to be chamfered.

Figure 3:
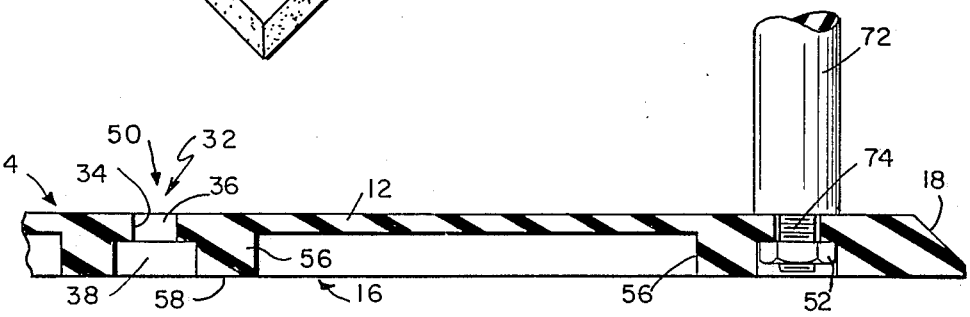
FIG. 3 is a sectional view taken along lines 3—3 of FIG. 1.

The base plate 12 includes a plurality of slots 32 which are shown in FIG. 3 to be in the form of inverted T-shaped grooves. The grooves are defined by mutually confronting edges 34 and 36 which define an opening in the upper surface 14 of the base plate 12. The lower portion 38 of each slot 32 communicates with the lower surface 16 of the base 12. The lower portion 38 is larger in width than is the width between the confronting edges 34 and 36.

The plurality of slots 32 are made up of diagonal slots 40 and 42 which intersect at a point 44 along the longitudinal axis X—X of the base near, but slightly rearward from, the center of the forward extension portion 22 of the base. Each of the diagonal slots 40 and 42 terminate in rearwardly extending forward portions 46 and rearwardly extending rear portions 48. A slot 50 is situated to extend rearwardly from the intersection point 44 of the two diagonal slots 40 and 42 along the longitudinal axis X—X of the base plate 12. The plurality of slots 32 are designed to receive a fastening means 52 for retaining a ball support 54 in an upright position with respect to the base plate 12.

Figure 2:
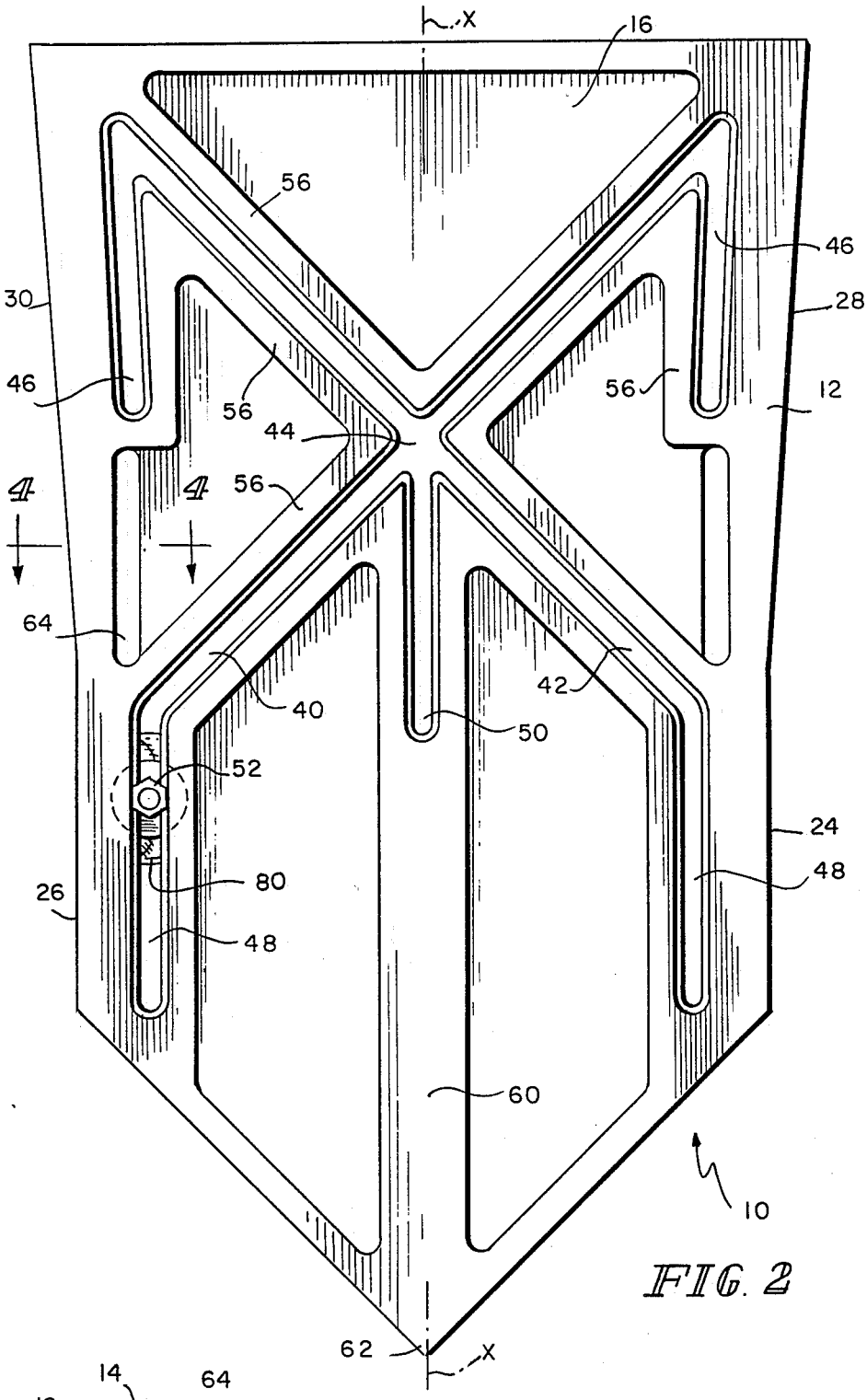
FIG. 2 is a bottom plan view of the batting tee shown in FIG. 1.

As can be seen in FIGS. 2 and 3, the lower portions 38 of the slots 32 are bounded by downwardly extending ribs 56 which act to provide for support and reinforcement of the slots 32. The lower extremity 58 of the ribs 56 is coplanar with the bottom surface 16 of the perimeter 18. A central rib 60 extends rearwardly from the central slot 50 along the axis X—X to the rearward apex 62 of the home plate portion 20 of the base plate 12. The central rib 60 contributes strength particularly to the central slot 50.

Figure 4:
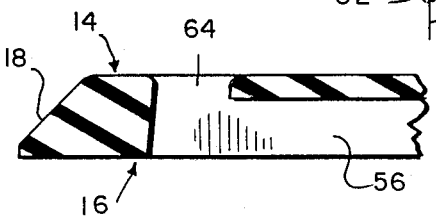
FIG. 4 is a sectional view taken along lines 4—4 of FIG. 2.

The base plate 12 further includes hand-holds 64 as shown in FIGS. 2 and 4 which allow ease of carrying a batting tee 10 in accordance with the present invention.

The upper surface 14 of the base plate 12 includes surface decorations 64 which aid in the instruction of proper batting techniques. The edges of slot 40 and the rearward extensions 46 and 48 from the ends of slot 40 are shown to be decorated with a colored margin 64. Diagonal slot 42 and the rearwardly extensions 46 and 48 from diagonal slot 42 are shown to have a decorated margin 66 of another color. As illustrated in FIG. 1, the margin 64 is lined for the color red while the margin 66 is lined for the color blue.

While the difference in color is important in fully utilizing the apparatus in conjunction with the applicant's teaching of swing technique, the particular choice of colors is arbitrary. The central slot 50 is shown to be colored using both colors. In addition, it is preferable that the home plate portion 20 have a surface color different from the forward extension portion 22. Both the home plate portion 20 and forward extension portion 22 should provide a background for the colored marginal portions 64 and 66 as well as for the perimeter color 68 outlining the home plate portion.

The ball support 54 includes a lower portion 72 including a threaded fastener 74 projecting into one of the plurality of slots 32 to engage the fastening means 52. The upper portion 76 is vertically movable with respect to the lower portion 72 in a known manner and includes at it upper extremity 78 means for receiving a ball 80. The adjustability of upper portion 76 with respect to lower portion 72 assures that the ball 80 can be positioned vertically at any position appropriate to the particular batter in question. Further, the vertical ball support 54 can be positioned at any position within the plurality of slots 32 by merely loosening the fastening means 52 and sliding the ball support 54 to the desired location where the fastening means can again be retightened.

Although the invention has been described in detail with reference to the illustrated preferred embodiment, variations and modifications exist within the scope and spirit of the invention as described and as defined in the following claims.

What is claimed is:

1. A batting tee comprising: a base having an upper and lower surface, the upper surface integrally including an elongated slot extending in a plurality of discrete directions over said surfaces, a fastener situated in said slot and adjustably movable with respect thereto, and an upright ball support having a lower end coupled to the fastening means and an upper end adapted to support a ball.

2. The batting tee of claim 1 wherein the base includes a perimeter joining the upper and lower surfaces and encompassing an area having a configuration of the sum of a conventional home plate and a forward extension thereto having outwardly flaring side edges.

3. The batting tee of claim 2 wherein the upper surface of the base is divided by a difference in surface color into the conventional home plate and forward extension portions.

4. The batting tee of claim 3 wherein a major portion of said slot extending said slot extend in the forward extension portion of the base.

5. The batting tee of claim 4 wherein a portion of said slot extend along an axis dividing the base into mirror symmetric right and left halves.

6. The batting tee of claim 5 wherein a portion of said slot extend along diagonals of the forward extension portion of the base.

7. The batting tee of claim 6 wherein a portion of said slot extend along diagonals of the forward extension and along said rearwardly extending portions.

8. The batting tee of claim 7 wherein said slot intersect itself at about the center of the forward extension portion of the base.

9. The batting tee of claim 8 wherein the fastener includes a head portion trapped by edges defining said slot and a stem portion projecting upward between the slot edges and engaging the upright ball support.

10. The batting tee of claim 9 wherein the upper end and the lower end of the upright ball support are vertically adjustable with respect to each other.

11. A batting tee comprising: a base having an upper surface and a lower surface including an elongated slot extending in a plurality of discrete directions over said surface, a perimeter joining the upper and lower surfaces and encompassing an area having a configuration of the sum of a conventional home plate and a forward extension thereto having outwardly flaring side edges, a fastener situated in and adjustably movable with respect to said slot, and an upright ball support having a lower end coupled to the fastener and an upper end adapted to support a ball.

12. The batting tee of claim 11 wherein said slot is comprised of an inverted T-shaped groove including mutually confronting edges.

13. The batting tee of claim 12 wherein the fastener includes a head portion trapped by the mutually confronting edges of said slot and a stem portion projecting upward between the slot edges and engaging the upright ball support.

14. The batting tee of claim 13 wherein the stem portion of the fastener includes a threaded portion, and the upright ball support lower end comprises a matching threaded portion adjustably engaged with the fastener.

15. The batting tee of claim 12 wherein a portion of the upper surface contiguous to the confronting edges is distinguished from the remainder of the upper surface by a difference in surface color.

16. The batting tee of claim 15 wherein said slot has a portion thereof extending along diagonals of the forward extension portion of the base, the surface color contiguous to the confronting edges of said slot being different for the surface color contiguous to the confronting edges of the other of said diagonal slots.

17. The batting tee of claim 16 wherein said diagonals of said forward extension include appended rearwardly extending portions, each of the rearwardly extending portions being outlined by contiguous surface color identical to the diagonal to which the extending portions is appended.

18. The batting tee of claim 15 wherein said slot further extend along an axis dividing the base into mirror symmetric right and left halves, said slot further extension intersecting said diagonal of said slot, the two confronting edges of said further extension having distinguishing surface color which is different from each other.

19. A base for a batting tee comprising:

a generally flat plate having an upper surface a lower surface, a perimeter joining the upper and lower surfaces and encompassing an area having a configuration of the sum of a conventional home plate and a forward extension thereto, the upper surface being divided by a difference in surface color into the conventional home plate portion and forward extension portion;

said plate having an elongated slot extending in a plurality of discrete directions over said surfaces, said slot being of inverted T-shaped configuration and further defining mutually confronting edges, a portion of the upper surface contiguous to the confronting edges being distinguished from the remainder of the upper surface by a difference in surface color to outline said slot; and means engaged in said slot and adjustably movable with respect thereto for retaining a ball support in an upright position.

20. The base of claim 19 wherein said forward extension portion comprises an area greater than the home plate portion bounded by outwardly flaring side edges and a front edge, a predominant portion of said slot extending into the forward extension portion.

* * * * *

UNITED STATES PATENT AND TRADEMARK OFFICE

CERTIFICATE OF CORRECTION

PATENT NO. : 4,962,924

DATED : October 16, 1990

INVENTOR(S) : William J. James

It is certified that error appears in the above-identified patent and that said Letters Patent is hereby corrected as shown below:

In column 4, line 2, please delete the phrase "said slot extend".

Signed and Sealed this

Twenty-first Day of April, 1992

*Attest:*

HARRY F. MANBECK, JR.

*Attesting Officer*

*Commissioner of Patents and Trademarks*